US006759606B2

(12) United States Patent
Fortuny Riera

(10) Patent No.: US 6,759,606 B2
(45) Date of Patent: Jul. 6, 2004

(54) MEMBRANE SLIDE SWITCH

(75) Inventor: Josep Maria Fortuny Riera, Valls (ES)

(73) Assignee: Lear Automotive (EEDS) Spain, S.L., Tarragona (ES)

( * ) Notice: Subject to any disclaimer, the term of this patent is extended or adjusted under 35 U.S.C. 154(b) by 0 days.

(21) Appl. No.: 10/203,208

(22) PCT Filed: Feb. 12, 2001

(86) PCT No.: PCT/ES01/00047

§ 371 (c)(1),
(2), (4) Date: Jan. 28, 2003

(87) PCT Pub. No.: WO01/59797

PCT Pub. Date: Aug. 16, 2001

(65) Prior Publication Data

US 2003/0150700 A1 Aug. 14, 2003

(30) Foreign Application Priority Data

Feb. 11, 2000 (ES) ..... 200000315

(51) Int. Cl.[7] ..... H01H 9/00
(52) U.S. Cl. ..... 200/5 R; 200/517
(58) Field of Search ..... 200/5 R, 17 R, 200/6 A, 18, 517

(56) References Cited

U.S. PATENT DOCUMENTS 4,695,682 A 9/1987 Winogrocki ..... 200/38 R
4,918,264 A * 4/1990 Yamamoto et al. ..... 200/5 R
5,021,614 A * 6/1991 Sasaki et al. ..... 200/5 R
5,047,596 A * 9/1991 Ebishi ..... 200/4
5,147,990 A * 9/1992 Dionisio et al. ..... 200/16 R
5,442,149 A 8/1995 Sato ..... 200/5 R
5,834,716 A * 11/1998 Lee ..... 200/5 R
5,901,839 A 5/1999 Sasaki et al. ..... 200/551
6,252,183 B1 * 6/2001 Shirai ..... 200/5 R

FOREIGN PATENT DOCUMENTS

EP 0 124 751 A2 11/1984
EP 0 530 509 B1 6/1996
EP 0 890 966 A1 1/1999
EP 0 966 012 A1 12/1999

* cited by examiner

*Primary Examiner*—Michael A. Friedhofer
(74) *Attorney, Agent, or Firm*—Nixon Peabody LLP; Jeffrey L. Costellia

(57) ABSTRACT

It consists of a body (1) having a sliding key (2) that may activate some side actuators (7, 8), and a central actuator (9), which act over the upper base of the cones (13) of a membrane (14) triggering a determined part of a circuit (15). For this purpose, there are at least two fixed guides (5, 6) between the key (2) and the actuators (7, 8, 9) to guide the sliding of a runner (3) rigidly joined to the key (2) that serves to activate the actuators (7, 8, 9). The runner (3) includes a sliding strip (17) having pivots (18) housed in some crossed slots (19, 20) formed in the fixed guides (5, 6), permitting the guided displacements of the key (2) with the runner (3) in two perpendicular directions to activate the mentioned actuators (7, 8, 9).

4 Claims, 3 Drawing Sheets

MEMBRANE SLIDE SWITCH

BACKGROUND OF THE INVENTION

1. Field of the Invention

This patent application, as its title indicates, consists of a "SLIDING MEMBRANE SWITCH", whose new characteristics of constructions shape and design fulfil the purpose for which it was specifically designed, with maximum security and effectiveness and providing numerous advantages like those indicated in the present specifications.

2. Description of the Related Art

There exist switches intended to control different movements of a mechanism that incorporates, in the same body of the switch, several contact components controlling the passage of the current from the electric circuit that corresponds to each one of the mechanisms controlling the mentioned switch. As an example, in the field of automobiles, switches are known by which the user may control the position of the seat by means of the arrangement of a series of electric motors and devices. Said switches include two multidirectional activation levers, with up to six movements each, one extended over numerous legs acting on electric connectors. The movement of one of the levers in a determined direction provokes the contact of one of said legs with the corresponding connector, activating one part of the seat. Therefore, with a same switch it is possible to adjust the seat as to the distance from the steering wheel, in height, in angle, etc. Another alternative of the switch described are those configured by switch modules, each one of which are destined to control a movement. However, both types of switches have the disadvantage of being complicated to manufacture and assemble. In the case of lever switches, the structure is complex due to the fact that they have to have as many springs and legs as required for the control of the different mechanism movements. In the second case, the arrangement of switch modules makes the combination expensive for not dealing with a single switch.

BRIEF SUMMARY OF THE INVENTION

This invention has been developed so as to solve the disadvantages of known switches, providing a sliding membrane switch, capable of controlling the different movements of a determined mechanism by means of a simple configuration from the construction and functional standpoint.

With a sliding membrane switch in accordance with the present invention, the goals foreseen as well as added advantages are obtained, as is described below.

The switch, purpose of the invention, is of the type that includes a body having a switch destined to trigger different actuators. The latter basically consists of two aligned arms that protrude in an opposing manner from a swinging body. The ends of said arms are destined to respectively act over the upper base of the cones of a membrane to activate a specific part of a circuit. The particularity of the switch of the invention lies in that it includes a strip and at least two fixed guides arranged between the key and the corresponding actuators and has the purpose of guiding the sliding movement of the runner found rigidly joined to the key. The sliding of the key by the user provokes the sliding of the mentioned runner, provoking the consequent triggering of a determined actuator that, in turn, makes contact with the printed circuit membrane.

In a preferred embodiment of what is the purpose of this invention, said runner consists of a sliding strip having at its opposite ends two pivots which are extended upwards. Said pivots are respectively housed inside the mentioned fixed guides, which have two longitudinal grooves arranged perpendicular to each other. The arrangement of said guide grooves permits the displacement of the key together with the runner in two perpendicular directions, and therefore allows the triggering of two actuators installed such that their arms are perpendicular to each other.

Preferably, the sliding switch of the invention includes a central actuator and two side actuators, each one of which has the aforementioned configuration, that is, formed by two aligned arms which protrude opposite to each other from a swinging body. The side actuators are arranged such that their arms are parallel to each other and perpendicular to those of the central actuator. The arrangement described configures a six position sliding membrane switch, which may be used advantageously for the activation, for example, of the vehicle seat, permitting the back inclination to be controlled and adjusted, as well as the height and the distance of the user from the steering wheel, it being possible to use it with configurations of two and four movements with the elimination of the corresponding actuators.

According to another aspect of this invention, the aforementioned central actuator consists of a pivot that protrudes upwards and is suitably sized to be located in a rotary manner in a lower housing of the runner. In this way, the displacement of the runner provoked by the movement of the key executed by the user has as a result, the swinging of the central actuator that triggers one of the actuator arms making contact with a membrane cone.

The switch of the invention has a simple construction and is economic to manufacture, allowing several different mechanisms of a system to be activated effectively, thanks to the different positions enabling the mentioned guides in combination with the runner associated to the key.

BRIEF DESCRIPTION OF THE DRAWINGS

The characteristics and advantages of the sliding membrane switch described will result evident from the detailed description of a preferred realisation of same, which will be showed, hereinafter, as an example, non-limiting, in the manner referred to in the attached drawings, which.

Figure 1:
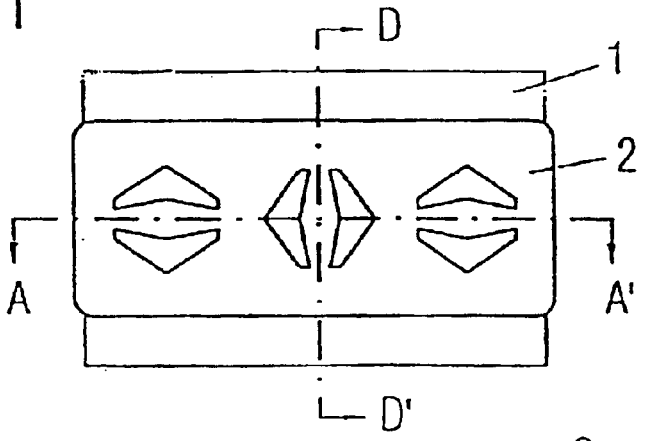
FIG. 1 is a plan view of the switch runner of the invention, indicating the possible movements of the key.

FIG. No. 3 is a side elevated view cut along the plane A–A' of FIG. 1.

Figure 2:
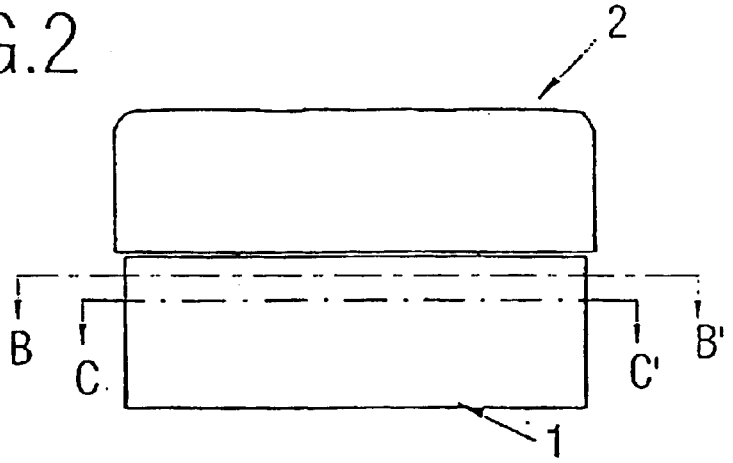
FIG. 2 is a side elevated view of the switch of this invention in an assembled position.
Figure 4:
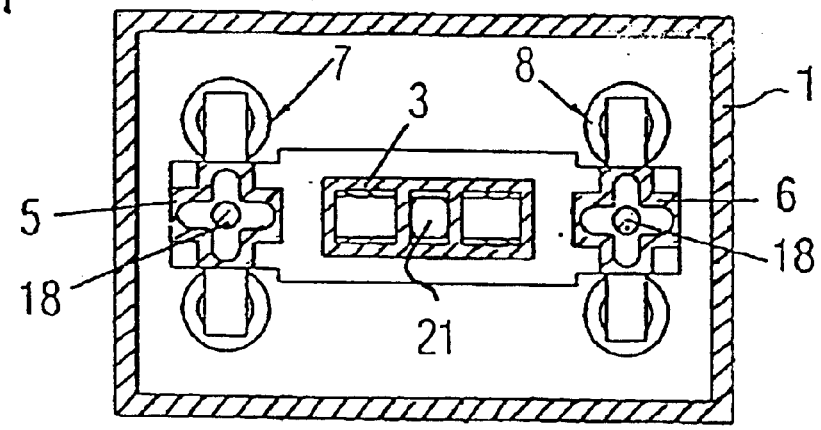

FIG. 4 is a plan view of the switch cut along the plane B–B' of FIG. 2.

Figure 5:
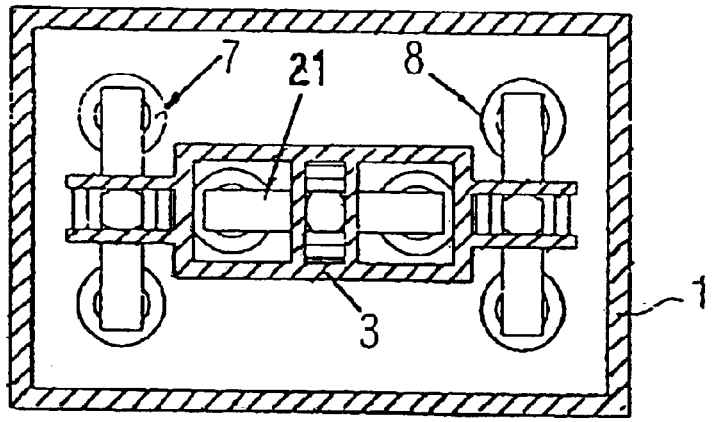

FIG. 5 is a plan view of the switch cut along the plane C–C' of FIG. 2.

Figure 6:
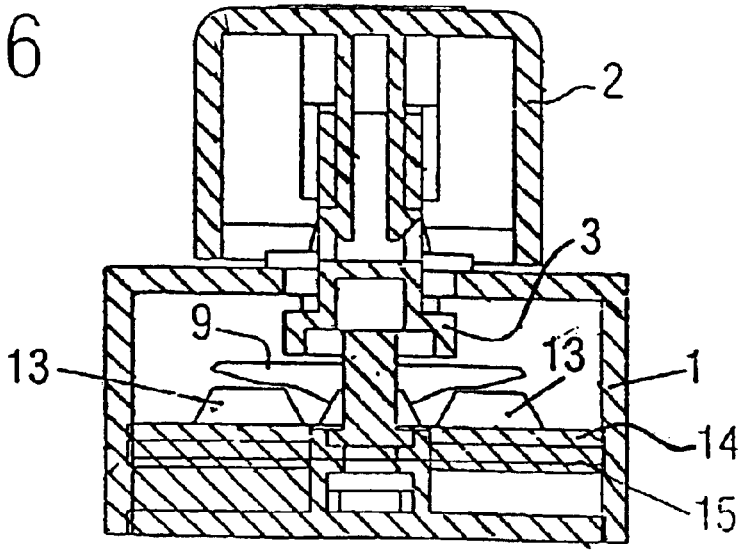

FIG. 6 is a front elevated view cut along the plane D–D' of FIG. 1.

Figure 7:
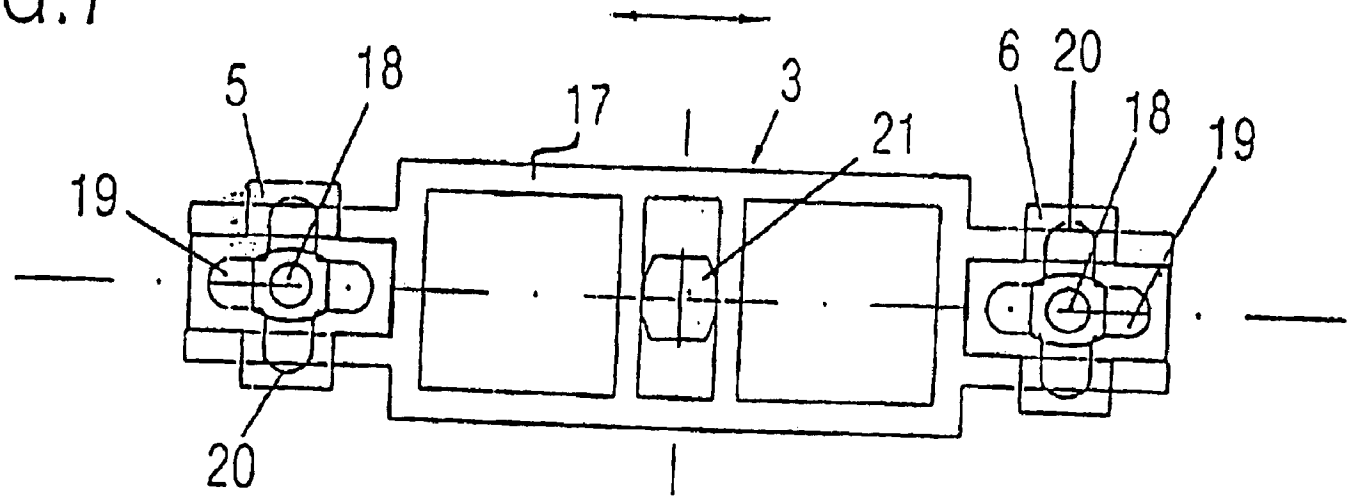

FIG. 7 is a plan view of the runner and the guides illustrating the operation of the switch of the invention when the central actuator is triggered.

And FIG. No. 8 is a plan view of the runner and guides of FIG. 7, showing the operation of the switch when one of the side actuators is triggered.

DETAILED DESCRIPTION OF THE INVENTION

The components described in the figures correspond to: (1) switch body, (2) sliding key, (3) runner, (4) runner fastener, (5) fixed guide, (6) fixed guide, (7) side actuator, (8) side actuator, (9) central actuator, (10) swinging actuator body, (11, 12) actuator arms, (13) conductor membrane cone, (14) conductor membrane, (15) printed circuit, (16) runner block, (17) sliding strip, (18) runner pivots, (19) fixed guide slot, (20) fixed guide slot, (21) central actuator pivot, (22) runner housing and (24, 25) activation direction of the side actuators.

The sliding membrane switch shown as an example in the attached drawings of these specifications, consist of a body (1) and a sliding key (2) rigidly joined to a runner, represented by (3) in the figures. In the realisation illustrated in the figures, a runner (3) fastener (4) is laid out and the body (1) includes two fixed guides (5, 6). In this sense, it should especially observed that the switch includes two side actuators (7, 8) and a central actuator (9) fitted in such a way that the mentioned side actuators (7, 8), have their arms parallel to each other and perpendicular to the arms of the central actuator (9). Each one of said actuators consists of a swinging body (10) from which emerge in an opposing manner two aligned arms (11, 12), whose ends may respectively act over the upper base of the contact (14) membrane cones (13) to activate a determined part of a printed circuit or PCB (15).

The sliding of the key (2) by the user provokes sliding of the runner (3), which provokes in turn, the triggering of the actuators (7, 8, 9). The fixed guides (5, 6) guide the sliding movement of the runner (3) so as to suitably act over each actuator (7, 8, 9) to trigger the pertinent mechanisms.

In the illustrated embodiment, the runner (3) is formed by d block (16) which in its lower part is extended in a sliding strip (17) which has, at its opposite ends, two pivots (18) which are extended upwards and which are housed in some slots (19, 20). Said slots (19, 20) are arranged perpendicularly forming a cross, as illustrated in the plan view of FIGS. 4 and 7. These crossed slots (19, 20) advantageously allow for the displacement of the key (2) with the runner (3) in two perpendicular directions that determine the activation of the side actuators (7, 8).

Figure 3:
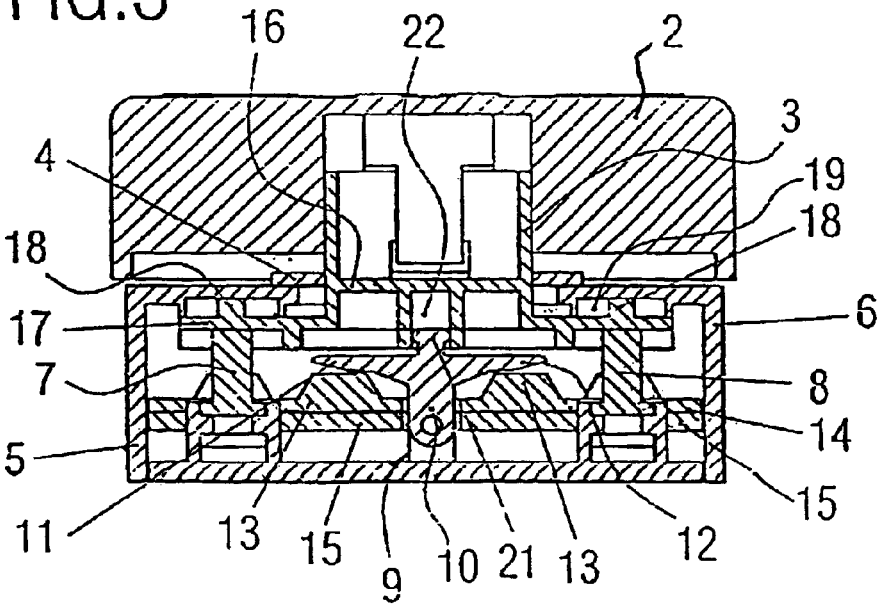

On the other hand, the central actuator (9) has a central actuator pivot (21) that emerges upwards. This central actuator pivot (21) has a widened end and a rounded contour adapted to be installed in a rotary manner in a housing (22) of the runner (3), as shown in FIG. 3 of the drawings.

Therefore, in the switch of the invention, six activation positions are established, which may be understood by observing the attached figures together with the description that follows.

Firstly, the central actuator (9) may be activated by swinging its two arms (11, 12) according to FIG. 7. This will permit the control of the movement of a first mechanism, for example the control mechanism of the distance of the vehicle steering wheel.

Figure 8:
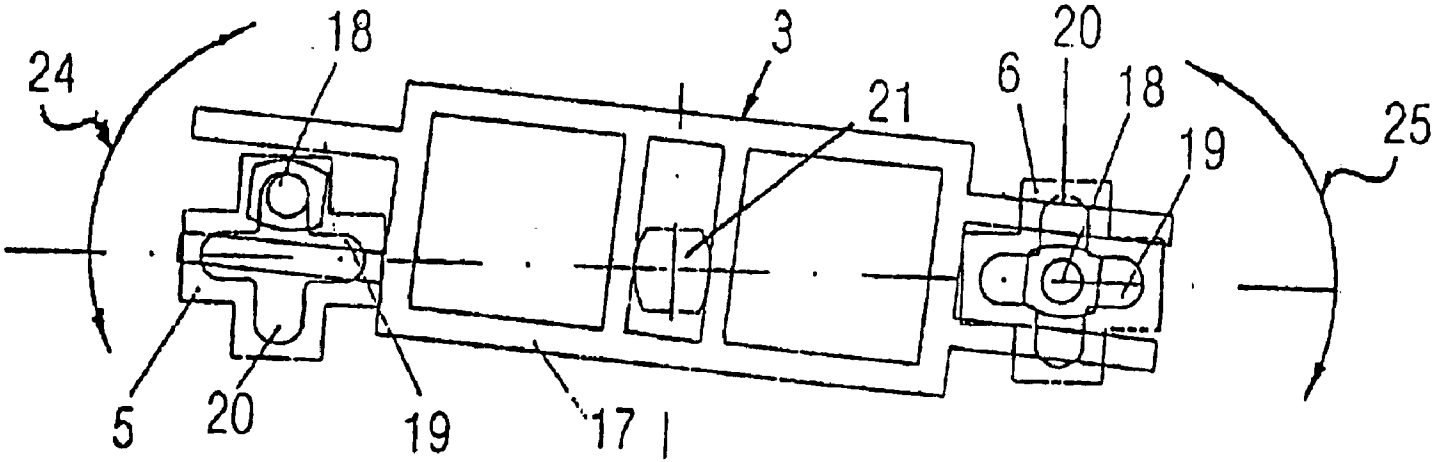

Secondly, the side actuator (7) may be activated by swinging its two arms (11, 12) moving the key (2) of the switch in the direction of the arrow (24) of FIG. 8, by which the movement of a second mechanism may be controlled, for example a height adjustment device of the front part of the vehicle seat.

Thirdly, the sliding key (2) may be moved in the direction indicated by the arrow (25) of said FIG. 8 for the side actuator (8) to swing, hence permitting the control of the movement of a third mechanism, for example the adjustment mechanism of the height of the rear part of the vehicle seat.

Having sufficiently described the basis of this invention with reference to the attached drawings, it is understood that any detailed modification may be introduced, as considered convenient, provided it does not change the essential characteristics of the invention, summarised in the following CLAIMS.

What is claimed is:

1. A sliding membrane switch, comprising: a body with a key, a first actuator, a second actuator and a third actuator, wherein each of said first, second and third actuator comprises two aligned arms emerging oppositely from a swinging body, said two alignment arms comprise ends that respectively act over an upper base of cones of a contact membrane so as to trigger a predetermined part of a circuit;

the sliding membrane switch further comprising a strip and at least two fixed guides arranged between said key and said corresponding first, second and third actuators, wherein said fixed guides serve to guide the sliding movement of a runner rigidly joined to said key, and said runner being utilized for activating the first, second and third actuators.

2. A sliding membrane switch, according to claim 1, wherein said runner comprises a sliding strip having, at its ends, runner pivots (18) extended upwards and respectively housed in crossed slots formed in the fixed guides, allowing the guided displacement of the key with the runner in two perpendicular directions to activate said first, second and third actuators.

3. A sliding membrane switch, according to claim 1, wherein said first and second actuators are side actuators and said third actuator is a central actuator, said side actuators being arranged with their aligned arms parallel to each other and perpendicular with respect to the arms of the central actuator.

4. A sliding membrane switch according to claim 3, wherein the central actuator comprises a pivot emerging upwards and which is inserted in a rotary manner in a lower housing of the runner, such that the a displacement of said runner provokes a swinging movement of the central actuator triggering the cone of the contact membrane.

* * * * *